US007922565B2

(12) United States Patent
Knisel et al.

(10) Patent No.: US 7,922,565 B2
(45) Date of Patent: Apr. 12, 2011

(54) DEVICE FOR COMMINUTING DRY ICE GRANULES, AND DRY ICE DISPENSING ARRANGEMENT HAVING SUCH A DEVICE

(75) Inventors: Bernd Knisel, Leonberg (DE); Ralf Schick, Auenwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 12/586,066

(22) Filed: Sep. 15, 2009

(65) Prior Publication Data

US 2010/0075579 A1 Mar. 25, 2010

Related U.S. Application Data

(63) Continuation of application No. PCT/EP2008/001960, filed on Mar. 12, 2008.

(30) Foreign Application Priority Data

Mar. 19, 2007 (DE) ..... 10 2007 014 284

(51) Int. Cl.
*B24C 7/00* (2006.01)

(52) U.S. Cl. ..... 451/99; 451/75; 451/90; 451/102; 62/604; 62/605; 241/273.1; 241/297; 241/95

(58) Field of Classification Search ..... 451/38, 451/40, 75, 90, 99, 102; 62/604, 605, 320; 241/43, 273.1, 296, 297, 298, 95
See application file for complete search history.

(56) References Cited

U.S. PATENT DOCUMENTS

| | | | | | |
|---|---|---|---|---|---|
| 4,727,687 | A * | 3/1988 | Moore | 451/75 |
| 5,419,138 | A * | 5/1995 | Anderson et al. | 62/605 |
| 5,426,948 | A * | 6/1995 | Hyde, Jr. | 62/604 |
| 5,473,903 | A * | 12/1995 | Lloyd et al. | 62/605 |
| 5,475,981 | A * | 12/1995 | Becker | 62/605 |
| 5,596,874 | A * | 1/1997 | Liu | 62/1 |
| 5,735,140 | A * | 4/1998 | Becker et al. | 62/605 |
| 5,845,516 | A * | 12/1998 | Allen, Jr. | 62/605 |
| 6,986,265 | B2 * | 1/2006 | Johansen | 62/604 |
| 2004/0121711 | A1 * | 6/2004 | Opel | 451/75 |
| 2005/0092017 | A1 * | 5/2005 | Becker | 62/604 |

FOREIGN PATENT DOCUMENTS

| | | |
|---|---|---|
| DE | 196 36 305 | 3/1998 |
| DE | 10 2004 045 770 | 9/2005 |
| DE | 20 2005 018 954 | 5/2007 |
| DE | 20 2007 001 220 | 5/2007 |

* cited by examiner

*Primary Examiner* — Eileen P. Morgan
(74) *Attorney, Agent, or Firm* — Lipsitz & McAllister, LLC

(57) ABSTRACT

The invention relates to a device for comminuting dry ice granules, comprising a housing having a flow channel for dry ice granules which can be applied, by means of compressed gas, to a surface to be cleaned, and also comprising a first comminution member for comminuting the dry ice granules which are to be dispensed. In order to provide a device of this kind with which different degrees of comminution of dry ice granules can be achieved in a simple manner, it is proposed according to the invention that the device has at least one second comminution member which can be disposed in the housing in a position in which a total degree of comminution, which is greater than the individual degree of comminution which can be achieved solely by the first comminution member, can be achieved in combination with the first comminution member. A dry ice dispensing arrangement for dispensing a mixture of compressed gas and dry ice granules is also proposed, having a device of the above kind.

19 Claims, 7 Drawing Sheets

DEVICE FOR COMMINUTING DRY ICE GRANULES, AND DRY ICE DISPENSING ARRANGEMENT HAVING SUCH A DEVICE

This application is a continuation of international application number PCT/EP2008/001960 filed on Mar. 12, 2008.

The present disclosure relates to the subject matter disclosed in international application number PCT/EP 2008/001960 of Mar. 12, 2008 and German application number 10 2007 014 284.8 of Mar. 19, 2007, which are incorporated herein by reference in their entirety and for all purposes.

BACKGROUND OF THE INVENTION

The invention relates to a device for comminuting dry ice granules, comprising a housing having a flow channel for dry ice granules which can be applied, by means of compressed gas, to a surface to be cleaned, and also comprising a first comminution member for comminuting the dry ice granules which are to be dispensed.

The invention also relates to a dry ice dispensing arrangement for dispensing a mixture of compressed gas and dry ice granules, having a device of the foregoing kind.

DE 10 2004 045 770 B3 discloses a dry ice spraying device for providing a mixture of compressed gas, preferably compressed air, and dry ice. In order to supply the compressed gas, the dry ice spraying device can be connected to a compressed gas source. The dry ice spraying device comprises a reservoir of dry ice and a metering device by which the dry ice can be mixed with the compressed gas. The dry ice is stored in the form of dry ice granules (so-called "pellets"), which are usually the size of grains of rice, and are introduced into the flow path of the compressed gas by means of the metering device, as a result of which said dry ice is mixed with the compressed gas. A dry ice dispensing unit which can be connected to the dry ice spraying device can be used to subject, for example, a surface to be cleaned to the action of pressurized dry ice granules. Contaminants which adhere to the surface are intensely cooled by the action of dry ice granules, as a result of which they become brittle and are detached from the surface. The dry ice granules which strike the surface sublimate on impact, that is to say pass directly from the solid state to the vapor state, and in the process assist in detaching contaminants adhering to the surface.

The devices cited in the introduction for comminuting dry ice granules (so-called "scramblers") are usually sold as accessory units for dry ice dispensing arrangements. In order to comminute dry ice granules, said devices comprise a flow channel through which the mixture of compressed gas and dry ice granules flows and on which a comminution member is disposed. If the dry ice granules which are mixed with compressed gas strike the comminution member, said dry ice granules can break up and as a result be comminuted. Consequently, the comminuted pellets are of smaller average size at the output end of the device than at the input end of the device. The dry ice granules comminuted in this way are suitable, for example for preferred cleaning of sensitive surfaces, fine structures or undercuts.

Generic devices for comminuting dry ice granules are known, in which devices the housing comprises a tube that surrounds the flow channel and into which a comminution member in the form of a metal wire is welded. This is complicated in terms of production and, furthermore, the wire is subject to a high level of wear.

In the case of other types of generic devices for comminuting dry ice granules, the comminution member is in the form of a grating mesh and is inserted into a tube which is surrounded by the housing. In such devices, there is a risk of the grating mesh becoming clogged up with dry ice granules during operation, so that the flow channel becomes blocked.

Furthermore, the two devices for comminuting dry ice granules described above encounter the problem that the degree of comminution of dry ice granules, that is to say the ratio of the average size of the pellets at the input end of the device to the average size of the pellets at the output end of the device is inalterable.

SUMMARY OF THE INVENTION

It is an object of the present invention to provide a device of the type mentioned in the introduction with which different degrees of comminution of dry ice granules can be achieved in a simple manner.

According to the invention, this object is achieved in the case of a device of the generic type in that the device has at least one second comminution member which can be disposed in the housing in a position in which a total degree of comminution, which is greater than the individual degree of comminution which can be achieved solely by the first comminution member, can be achieved in combination with the first comminution member.

In the present case, "position" is considered to be a spatial arrangement of the at least one second comminution member, relative to the first comminution member, in the housing or a part of said housing. The at least one second comminution member can assume a position in the housing in which the total degree of comminution, that is to say the degree of comminution of the dry ice granules after passing through the two comminution members, is greater than the individual degree of comminution which can be achieved solely by the first comminution member. Furthermore, the at least one second comminution member can be removed from the housing. This allows the device to also provide the individual degree of comminution which can be achieved solely by the first comminution member. The device according to the invention can therefore provide the option of achieving at least two degrees of comminution of dry ice granules in a technically simple manner by selective use of the at least one second comminution member.

In particular, provision may also be made for the first comminution member to be removable from the housing, so that only the at least one second comminution member can be disposed in the housing. This can provide the option of achieving an individual degree of comminution by means of the at least one second comminution member alone, said individual degree of comminution differing from the individual degree of comminution which can be achieved solely by the first comminution member. This is the case, for example, when the first comminution member and the at least one second comminution member differ in terms of configuration. In such an embodiment, a total of at least three degrees of comminution of dry ice granules can therefore be achieved by selective use of the first comminution member and/or of the at least one second comminution member.

The at least one second comminution member can preferably be disposed in the housing in a position in which the total degree of comminution is equal to the individual degree of comminution which can be achieved solely by the first comminution member. As a result, it is not necessary to remove the at least one second comminution member from the housing in order to achieve the individual degree of comminution which can be achieved solely by the first comminution member. Instead, the at least one second comminution member can remain in the housing. This reduces, for example, the risk of the at least one second comminution member being misplaced.

It is advantageous when the at least one second comminution member can be disposed in the housing in a plurality of positions in which the total degree of comminution is greater than the individual degree of comminution which can be achieved solely by the first comminution member. This makes it easier for a user to handle the device.

The magnitude of the total degree of comminution preferably differs in each of the plurality of positions of the at least one second comminution member in the housing. As a result, the device is versatile, since the first comminution member and the at least one second comminution member can be used to achieve a multiplicity of different total degrees of comminution of dry ice granules.

It is advantageous when the device has at least one second comminution member which is identical to the first comminution member. Due to the identical design, the production costs for the device can be reduced. If there are two or more second comminution members, provision may be made, in particular, for all the second comminution members to be identical to the first comminution member.

The device preferably has at least one second comminution member which is different from the first comminution member. Due to a different design, it is possible, for example, to in each case achieve different individual degrees of comminution with the first comminution member and the at least one second comminution member, it being possible for the user to choose between said individual degrees of comminution, in addition to the total degree of comminution. An embodiment of this type therefore has a high degree of versatility. If there are two or more second comminution members, provision may be made for all the second comminution members to be different from the first comminution member.

The first and/or the at least one second comminution member, for comminuting dry ice granules, preferably comprise/comprises a grating portion which can be positioned in the flow channel. By means of the grating portion the cross-section of the flow channel can be reduced. The dry ice granules conducted through the flow channel by means of compressed gas can strike the grating portion, break up and as a result be comminuted.

The at least one second comminution member can advantageously be moved to different positions, in which different total degrees of comminution can be achieved, by rotation of its grating portion relative to the grating portion of the first comminution member. This is a structurally simple way of achieving different total degrees of comminution with the first and the at least one second comminution member. In this case, provision may be made for the grating portion of the at least one second comminution member to be rotated about an axis of the flow channel. However, it is also possible for the grating portion of the at least one second comminution member to be rotated about an axis which is oriented transverse to the axis of the flow channel. The rotation may be performed, for example, through a predefinable angle; however, provision may also be made for the rotation angle to be infinitely variable. The grating portion can be rotated independently of the other portions of the at least one second comminution member and relative to said portions.

The first and/or the at least one second comminution member preferably have/has an edge portion by way of which the first and/or the at least one second comminution member can be supported on the housing. By virtue of being supported on the housing, it is possible to ensure that the first and/or the at least one second comminution member cannot move relative to the flow channel. The mechanical stability of the device can be improved as a result.

The edge portion of the first and/or of the at least one second comminution member preferably surround/surrounds at least part of a grating portion, which can be positioned in the flow channel, of the first and/or of the at least one second comminution member.

In a structurally simple configuration, the first and/or the at least one second comminution member are/is of disk-like form. The disk can have, for example, a grating portion which is at least partly surrounded by an edge portion.

The first and the at least one second comminution member, when they are disposed in the housing, are advantageously spaced apart from one another along the flow channel. This provides the option of comminuting dry ice granules flowing through the flow channel in first instance by the first comminution member and then by the at least one second comminution member which is spaced apart from said first comminution member. Comminution of the dry ice granules can therefore be effected, for example, in two planes which are spaced apart from one another. This reduces the risk of the first and/or the second comminution member becoming clogged up with dry ice during operation of the device.

When there are two or more second comminution members, it is advantageous, for the same reason, when all the second comminution members are spaced apart from one another along the flow channel.

It is advantageous when the housing has an accommodation body with at least one comminution member receptacle for the first and/or the at least one second comminution member. The first and/or the at least one second comminution member can be held, for example such that they/it cannot move, in the at least one comminution member receptacle. Provision may be made for the first and/or the at least one second comminution member to be disposed in a variety of positions in the at least one comminution member receptacle. In particular, a total degree of comminution which is different in each case can be achieved in each of the various positions.

The first and/or the at least one second comminution member can preferably be disposed in the at least one comminution member receptacle such that they/it cannot move relative to the flow channel.

It is advantageous when the at least one comminution member receptacle has a contact surface for the first and/or the at least one second comminution member, against which bearing surface said comminution member can rest and can be oriented relative to the flow channel. This simplifies handling of the device for a user. When the first and/or the at least one second comminution member are/is disposed in the at least one comminution member receptacle, the orientation of said first and/or said at least one second comminution member relative to the flow channel is simplified. As a result, it is possible to ensure that the first and/or the at least one second comminution member is in the correct position during operation of the device.

In a structurally simple refinement, the accommodation body is in the form of a hollow body which surrounds the flow channel at least along a sub-portion, the body being for example in the form of a hollow cylinder, with the flow channel running along the axis of said hollow cylinder.

A structurally simple refinement of the at least one comminution member receptacle can be achieved in that said at least one comminution member receptacle is in the form of a groove-like recess which is oriented transverse to the flow channel. The first and/or the at least one second comminution member, which are/is advantageously of disk-like form, can be disposed in the groove-like recess and oriented relative to the flow channel.

As an alternative, the at least one comminution member receptacle may be in the form of a gap-like through-opening which is oriented transverse to the flow channel.

The housing preferably has a sleeve which surrounds the accommodation body. This allows the device to be of compact design.

It is advantageous when the accommodation body can be fixed such that it cannot move relative to the flow channel. This provides, for example, the option of fixing the first and/or at least one second comminution member, which are/is disposed in the accommodation body, such that they/it cannot move relative to the flow channel. As a result, it is possible to ensure reliable functioning of the device. Fixing the accommodation body such that it cannot move relative to the flow channel can be achieved, for example, in that the accommodation body can be disposed in the above-described sleeve in a positively-locking manner.

It is advantageous when the housing has at least one housing cover which can be releasably connected to the sleeve. The cover can be used to close the sleeve, so that the accommodation body is reliably held in the sleeve with the first and/or at least one second comminution member which may be accommodated in said accommodation body. In order to remove the first and/or at least one second comminution member from the housing or to change the position of said first and/or at least one second comminution member in the housing, the cover can be detached from the sleeve, in order to remove the accommodation body from the sleeve. For particularly simple handling, the cover can be screwed to the sleeve.

As mentioned in the introduction, the invention also relates to a dry ice dispensing arrangement for dispensing a mixture of compressed gas and dry ice granules. It is an object of the present invention to develop such a dry ice dispensing arrangement so that it can be used to dispense, in a technically simple manner, dry ice granules having different degrees of comminution.

According to the invention, this object is achieved, in the case of a dry ice dispensing arrangement of the generic type, in that the dry ice dispensing arrangement comprises at least one device for comminuting dry ice granules, as described above.

The dry ice dispensing arrangement according to the invention therefore has the advantages which have already been described in conjunction with the explanation of the device.

The dry ice dispensing arrangement can be configured, for example, as a dry ice spraying device or else as a dry ice dispensing unit which can be connected to a dry ice spraying device. Said dry ice dispensing unit may be configured, for example, in the form of a spray gun. Provision may be made for the device according to the invention for comminuting dry ice granules to be disposed in or on the dry ice spraying device and/or in or on the dry ice dispensing unit. The comminution device according to the invention can preferably be releasably connected to the dry ice spraying device or to the dry ice dispensing unit, for example by screwing, in order to simplify handling.

The following description of preferred embodiments serves to explain the invention in greater detail, in conjunction with the drawings.

DETAILED DESCRIPTION OF THE INVENTION

Figure 8:
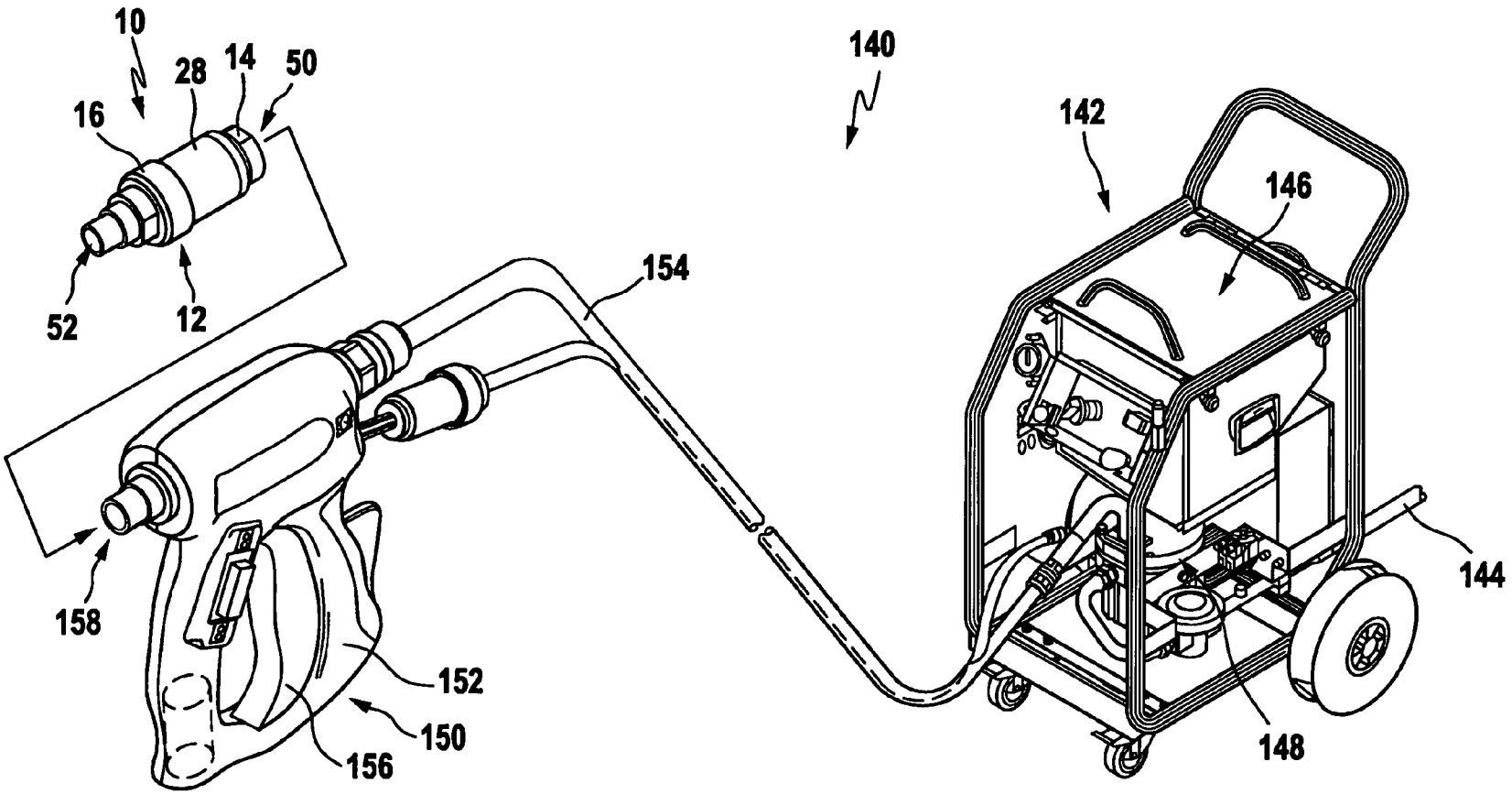
FIG. 8: shows a schematic view of a dry ice dispensing arrangement according to the invention.

In the drawing, a preferred embodiment of a device according to the invention for comminuting dry ice granules, designated "comminutor" in the text which follows, is provided with reference symbol 10. The comminutor 10 may be a constituent part of a dry ice dispensing arrangement according to the invention, as is illustrated in FIG. 8.

Figure 1:
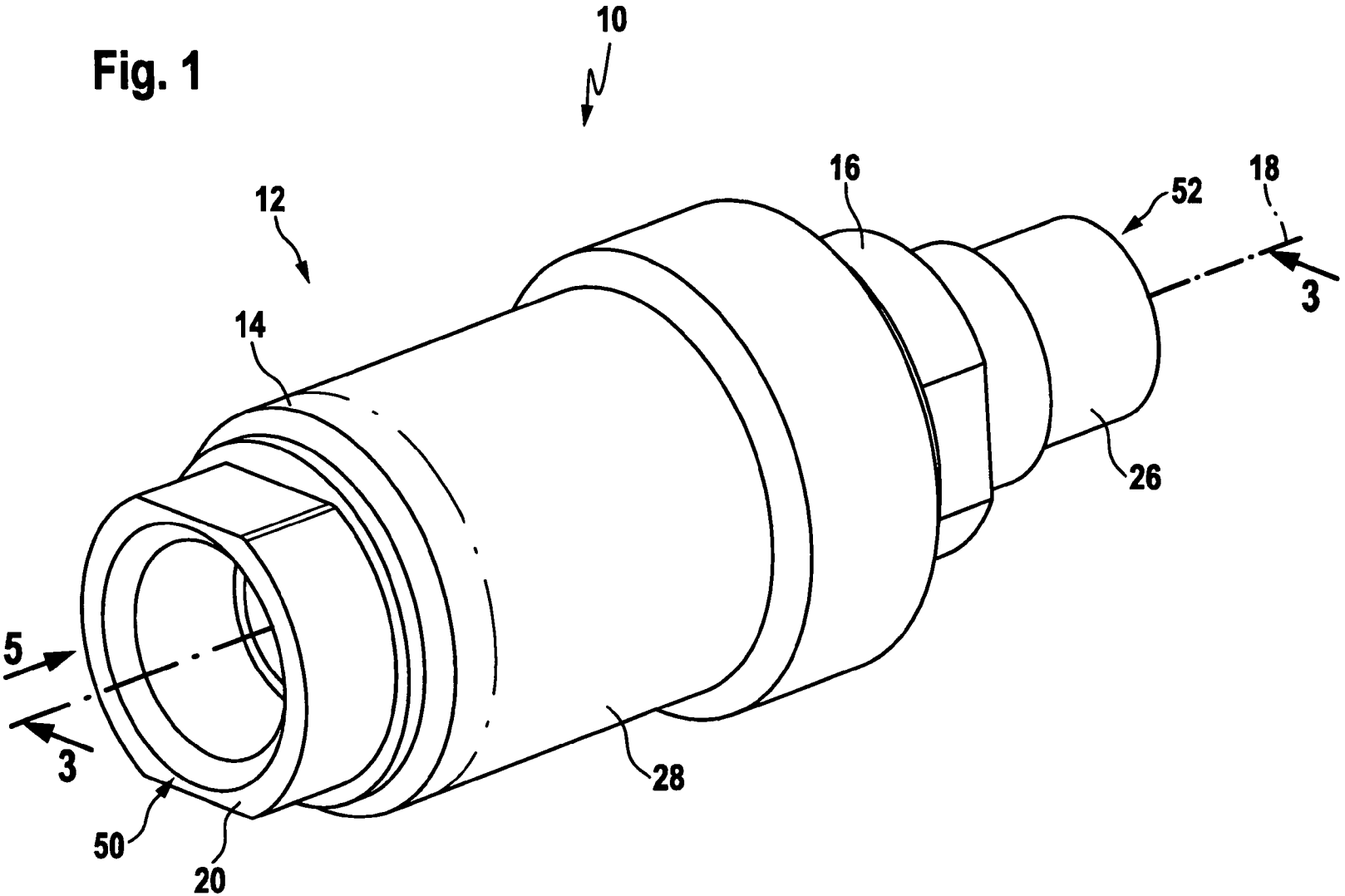
FIG. 1: shows a perspective illustration of a device according to the invention for comminuting dry ice granules.
Figure 2:
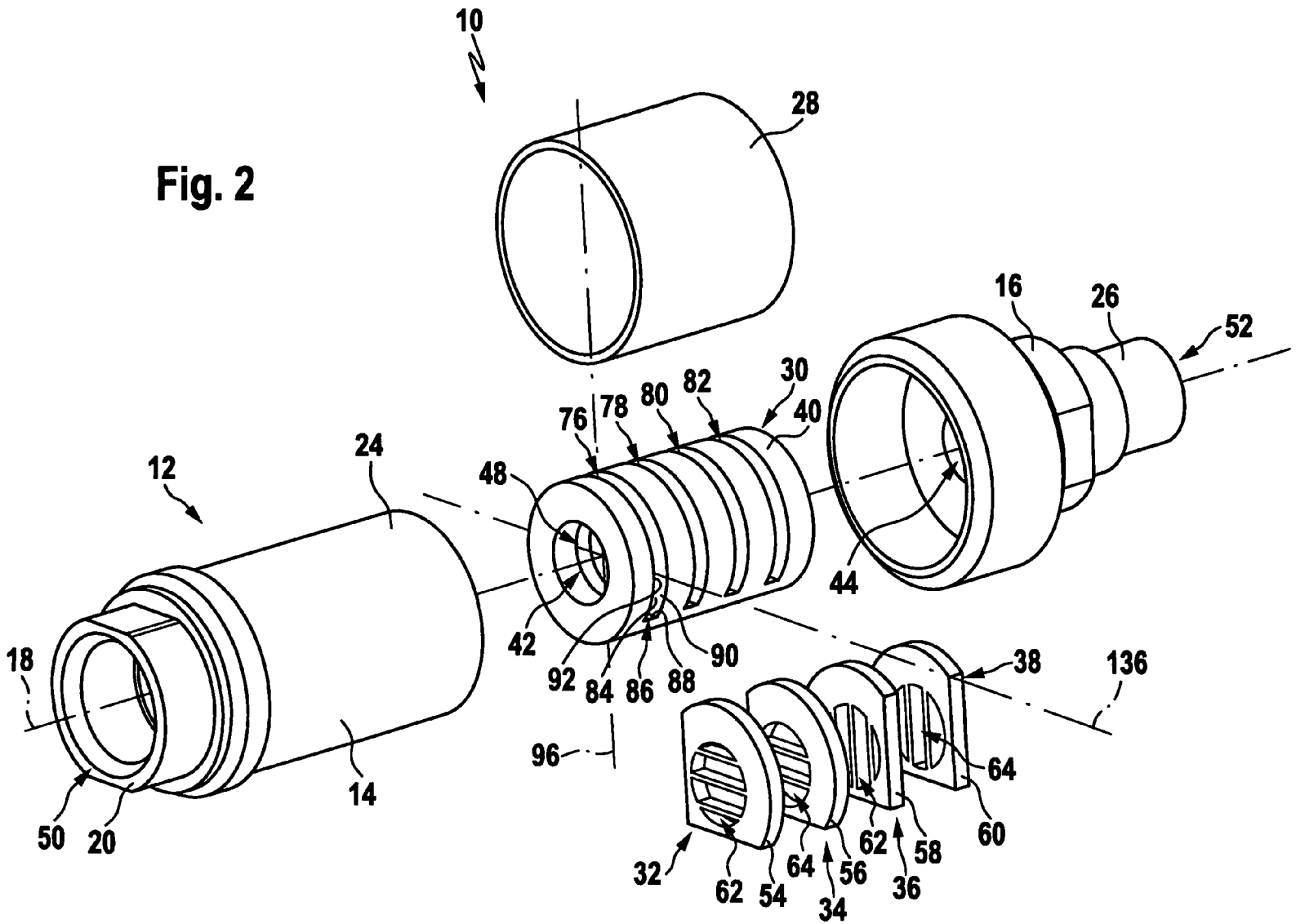
FIG. 2: shows an exploded illustration of the device from FIG. 1.
Figure 3:
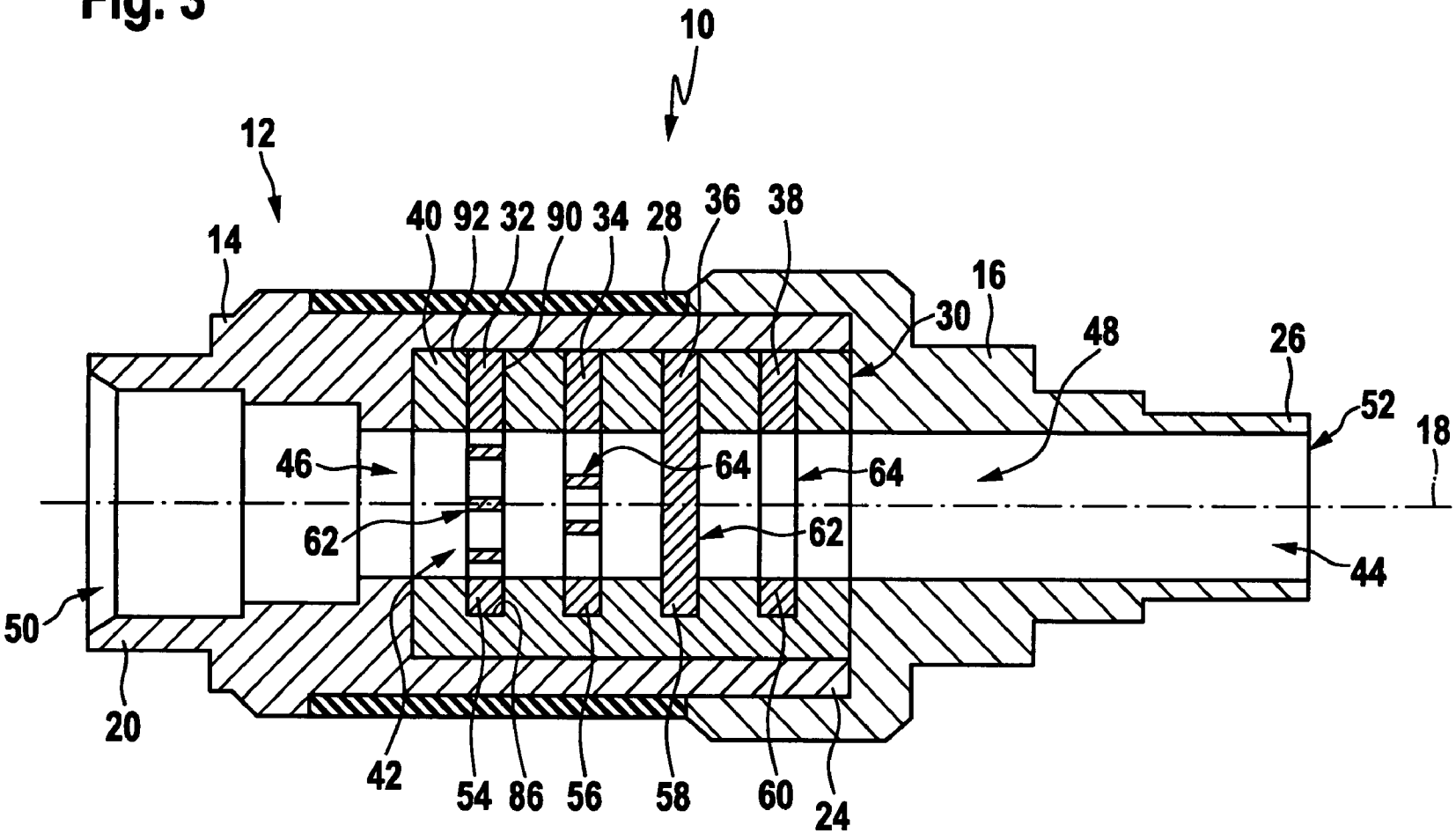
FIG. 3: shows a sectional view along line 3-3 in FIG. 1.

As is clear from FIGS. 1 to 3 in particular, the comminutor 10 has a housing 12 with a sleeve 14 and a housing cover 16 which can be releasably connected to the sleeve 14 and is likewise in the form of a sleeve. The sleeve 14 and the housing cover 16 have a common axis 18, said sleeve and housing cover being substantially rotationally symmetrical about said axis.

At its first sleeve end 20, which end 20 is directed away from the housing cover 16, the sleeve 14 has an internal thread (not shown in the drawing) by means of which it can be screwed, for example, to a dry ice dispensing unit of a dry ice dispensing arrangement. At its second sleeve end 24 which faces the housing cover 16, the sleeve 14 comprises an external thread (not shown in the drawing) which interacts with an internal thread (likewise not shown in the drawing) of the housing cover 16 for screw-connection of the sleeve 14 and the housing cover 16. The housing cover 16 has, at its cover end 26 which is directed away from the sleeve 14, an external thread (not illustrated in the drawing) onto which, for example, a spray nozzle of a dry ice dispensing arrangement can be screwed.

The housing 12 further comprises an external ring 28 which can be pushed over the sleeve 14 and is produced, for example, from rubber and acts in a thermally insulating manner during operation of the comminutor 10.

An accommodation body 30 for comminution members 32, 34, 36 and 38 for comminuting dry ice granules can be disposed in the interior of the sleeve 14. The accommodation body 30 is in the form of a hollow cylinder 40 and, when disposed in the sleeve 14, is aligned coaxially with the sleeve 14 and the housing cover 16. When the housing 12 is closed, that is to say with the housing cover 16 screwed onto the sleeve 14, the accommodation body 40 is held in the sleeve 14 such that it cannot move. The central through-hole 42 in said accommodation body 30 is aligned with a central through-hole 44 in the housing cover 16 and with a central through-hole 46 in the sleeve 14; in order to form a flow channel 48 which extends over the entire length of the housing 12. The first sleeve end 20 then forms an inlet 50 for the flow channel 48, and the cover end 26 forms an outlet 52 for the flow channel 48.

A mixture of compressed gas and dry ice granules, which mixture can be dispensed by a dry ice dispensing arrangement, can be conducted through the flow channel 48 and applied to a surface to be cleaned. The comminutor 10 thereby serves to comminute the dry ice granules in the manner described below.

As already mentioned, the comminutor 10 comprises comminution members 32, 34, 36, 38 for dry ice granules. In the text which follows, the comminution member 32 is designated the first comminution member 32 of the comminutor 10, and the comminution members 34, 36 and 38 are designated below as second comminution members of the comminutor 10. The comminution members 32, 34, 36 and 38 are in the form of disks 54, 56, 58 and 60, disk 58 being identical to disk 54 and disk 60 being identical to disk 56. Accordingly, disks 54 and 56 are different. In the text which follows, only the distinguishing features of disks 54, 56, 58 and 60 are provided with different reference symbols.

As is clear from FIGS. 4A to 4D in particular, the disks 54 and 56 comprise grating portions 62 and, respectively, 64 with grating bars 66 and, respectively, 68. The grating bars 66 of the disk 54 are disposed in a manner offset in relation to the grating bars 68 of the disk 56. The offset is equal to approximately half the distance between the grating bars 66. The grating portions 62 and 64 are each surrounded by an identical edge portion 70. The grating portions 62 and 64 have a round contour when disks 54, 56, 58 and 60 are seen in plan view, the diameter of said contour corresponding to the diameter of the through-hole 42 and therefore of the flow channel 48 in the accommodation body 30.

When seen in plan view, the disks 54, 56, 58 and 60 have the contour of a circle from which, on the outer side, two segments of a circle which are oriented perpendicular to one another have been removed, so that the edge portion 70 has two contact edges 72 and 74 which run at a right angle to one another.

In order to accommodate the disks 54, 56, 58 and 60, the accommodation body 30 comprises identical comminution member receptacles 76, 78, 80 and 82 (FIG. 2). These comminution member receptacles 76, 78, 80 and 82 each comprise a groove-like recess 84 which is oriented perpendicular to the axis of the hollow-cylindrical accommodation body 30 and therefore, when said hollow-cylindrical accommodation body 30 is disposed in the housing 12, perpendicular to the flow channel 48. The groove-like recesses 84 penetrate so deeply into the accommodation body 30 that they pass through the flow channel 48. A rectilinear groove base 86 in each case forms a contact surface 88 for the bearing edge 72 or 74 of a disk 54, 56, 58 and 60.

The width of the groove-like recesses 84 is such that the disks 54, 56, 58 and 60 can in each case be inserted between side walls 90 and 92 of a groove-like recess 84 without play. As a result, the edge portion 70 can be supported against the side walls 90 and 92, so that the disks 54, 56, 58 and 60 can be oriented in relation to the flow channel 48. In addition, one of the contact edges 72 and 74 can, as mentioned, selectively rest against the groove base 86.

The diameter of the accommodation body 30 corresponds to the diameter of the basic shape of the disks 54, 56, 58 and 60, that is to say not taking into account the separated-off segments of a circle.

As is clear from FIGS. 4A to 4D in particular, the comminution members 32, 34, 36 and 38 operate as follows:

In first instance, only the first comminution member 32 is disposed in the accommodation body 30, for example in the comminution member receptacle 76. The grating portion 62 is positioned in the flow channel 48 and reduces the cross-section of said flow channel 48. The reduction in the size of the cross-section of the flow channel 48 can be identified in FIG. 4D, in which the flow channel contour 94 is indicated in dashed lines over the contour of the grating portion 62.

Dry ice granules, which are conducted through the flow channel 48 by means of compressed gas, can strike the grating bars 66 of the grating portion 62 and as a result be comminuted. Consequently, the dry ice granules have an average size at the outlet 52 of the comminutor 10 which is smaller than the average size of the dry ice granules at the inlet 50 of the comminutor 10. The ratio of the average size of dry ice granules at the inlet 50 to the average size at the outlet 52 is designated the degree of comminution in the text which follows. If only one of the comminution members 32, 34, 36 or 38 is disposed in the accommodation body 30, the degree of comminution which can be achieved is designated the individual degree of comminution. Therefore, a certain individual degree of comminution can be achieved by means of the comminution member 32.

Now, the second comminution members 34, 36 and 38 may also be disposed in the accommodation body 30 in addition to the first comminution member 32, the disks 54 and 58 being oriented congruent to one another and the disks 56 and 60 being oriented congruent to one another. This corresponds to the combination of disks 54, 56, 58 and 60 illustrated in FIG. 4C. On account of the different grating portions 62 and 64, it is consequently possible to reduce the size of the cross-section of the flow channel 48 to a greater extent than is possible solely by the first comminution member 32.

Dry ice granules which are conducted through the flow channel 48 can now also be comminuted by striking the grating bars 68. Consequently, such a combination of the comminution members 32, 34, 36 and 38 can be used to achieve a total degree of comminution which is greater than the individual degree of comminution which can be achieved solely by the first comminution member 32.

Since the disks 54, 56, 58 and 60 can rest against the groove base 86 both by way of the contact edge 72 and by way of the contact edge 74, said disks can be disposed in different ways, that is to say in different positions, in the comminution member receptacles 76, 78, 80 and 82. It is possible to move one of the comminution members 32, 34, 36 or 38 from one position to another position by rotating the respective comminution member about the axis 18 or about an axis 96 which is oriented perpendicular to the axis 18 and to the groove base 86. In FIG. 2, the axis 96 is illustrated as running through the comminution member receptacle 76. Since the comminution member receptacles 76, 78, 80 and 82 are identical, the axis can also be considered to run through the comminution member receptacles 78, 80 and 82. The same applies to an axis 136 which is described below.

Figures 4A, 4B, 4C, 4D:
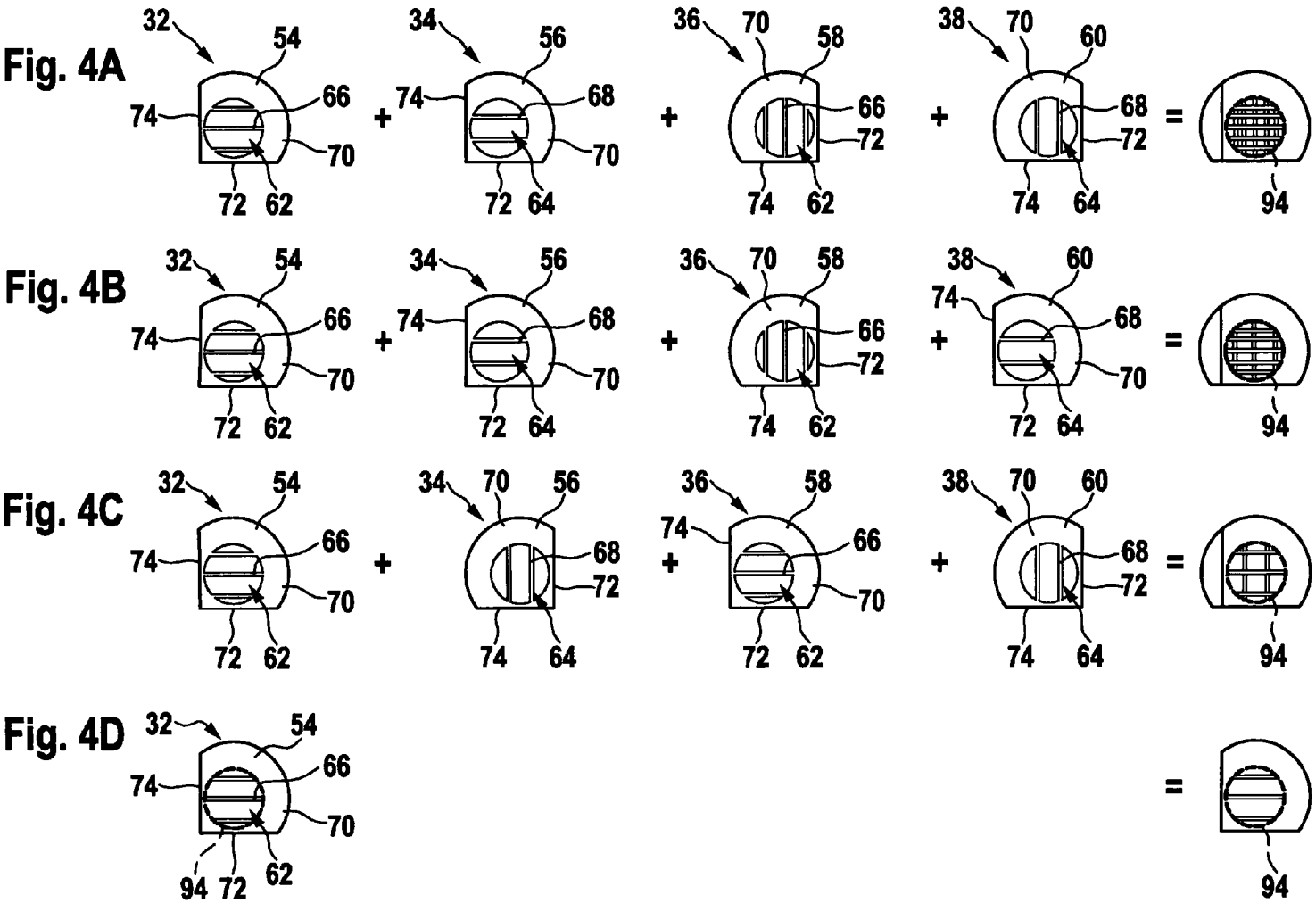
FIGS. 4A, 4B, 4C: show possible examples of the combination of comminution members of the device from FIG. 1 according to a first embodiment for achieving different total degrees of comminution.
FIG. 4D: shows a view similar to that of FIGS. 4A, 4B, 4C with just one comminution member.

On account of the ability to dispose the comminution members 32, 34, 36 and 38 in different positions in the comminution member receptacles 76, 78, 80 and 82, it is possible to achieve different reductions in the size of the cross-section of the flow channel 48 depending on the orientation of the grating portions 62 and 64 relative to one another. Consequently, the different arrangement of the comminution members 32, 34, 36 and 38 in the accommodation body 30 means a plurality of total degrees of comminution can be achieved. FIG. 4A shows the arrangement of the comminution members 32, 34, 36 and 38 from FIG. 2; FIGS. 4B and 4C show alternative arrangements.

Figure 5:
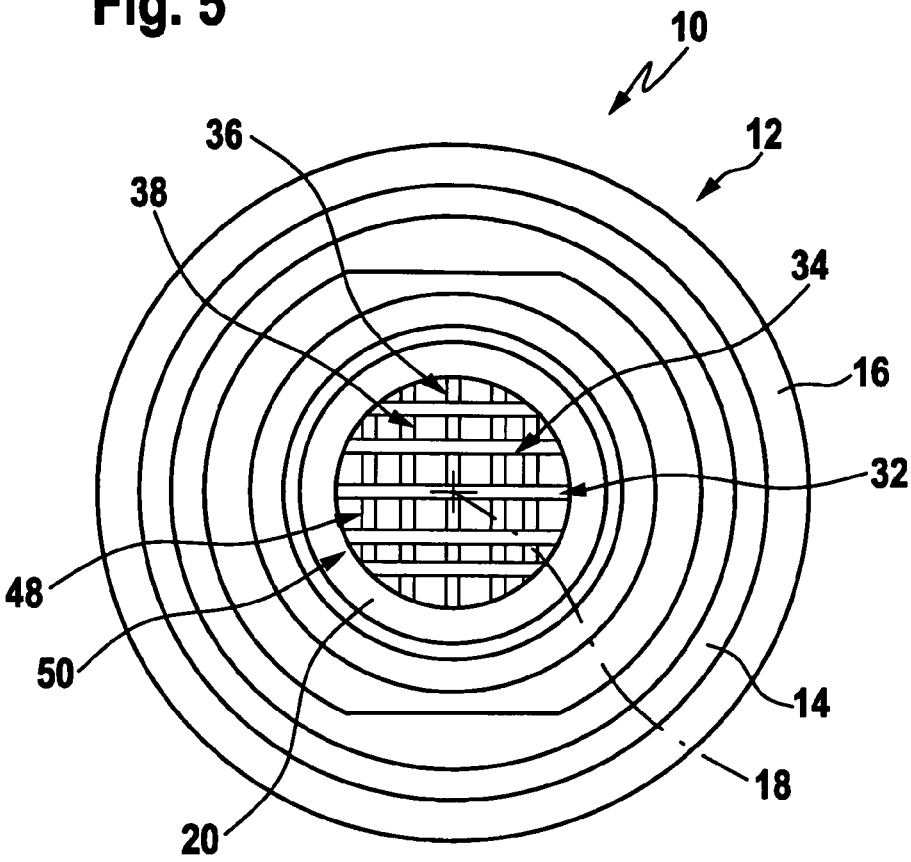
FIG. 5: shows a view of the device from FIG. 1 in the direction of arrow "5" in FIG. 1.

FIG. 5 shows a plan view of the comminutor 10, in which the reduction in the size of the cross-sectional area of the flow channel 48 in accordance with the combination of comminution members 32, 34, 36 and 38 shown in FIG. 4A can be identified.

Since the comminution member receptacles 76, 78, 80 and 82 are spaced apart from one another along the flow channel 48, the dry ice granules conducted through the flow channel 48 are comminuted in different planes. Consequently, this reduces the risk of the grating portions 62 and 64 being clogged up with dry ice granules during operation of the comminutor 10 and, as a result, the functioning of said comminutor being restricted. The degree of comminution of dry ice granules during operation of the comminutor 10 can be kept constant on account of the inability of the comminution members 32, 34, 36 and 38 to move relative to the flow channel 48.

Figure 6:
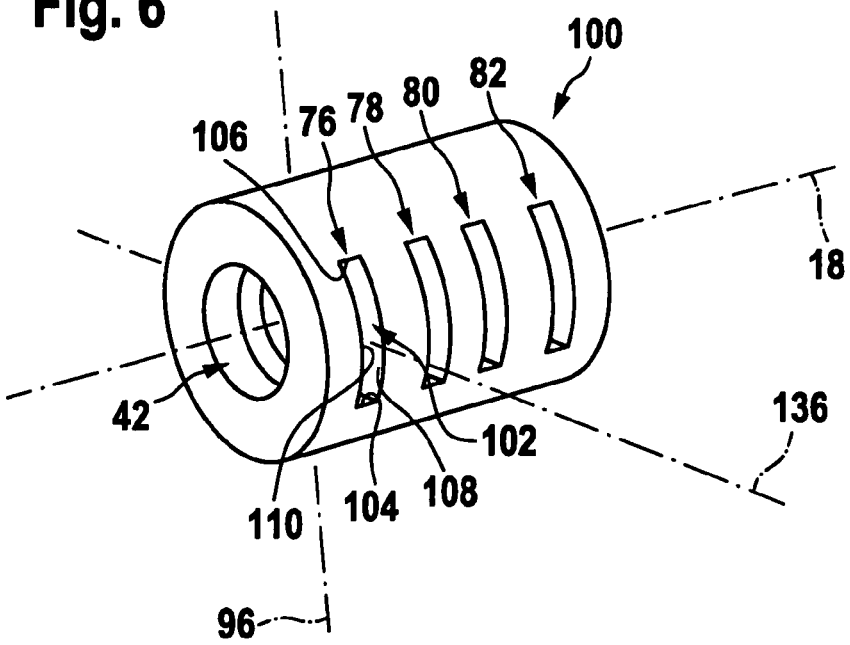
FIG. 6: shows an accommodation body for comminution members of the device from FIG. 1.

As an alternative to the accommodation body 30, the comminutor 10 can also comprise an accommodation body 100 which is illustrated in FIG. 6 and is of substantially the same construction as the accommodation body 30, and for this reason components which act in an identical manner to those of the accommodation body 30 are provided with the same reference symbols as in FIGS. 2 and 3. The accommodation body 100 comprises four identical comminution member receptacles 76, 78, 80 and 82 which are each in the form of a gap-like through-opening 102 in the accommodation body 100. The gap-like through-openings 102 are each oriented perpendicular to the through-hole 42 and therefore, during operation of the comminutor 10, perpendicular to the flow channel 48 through which they pass. Said gap-like through-openings 102 each comprise a base wall 104 and a top wall 106 which runs parallel to said base wall 104, said top wall 106 and base wall 104 being connected to one another by means of side walls 108 and 110.

Comminution members 112, 114, 116 and 118 which are illustrated in FIGS. 7A to 7D can be disposed in a positively-locking manner in the comminution member receptacles 76, 78, 80 and 82 of the accommodation body 100. In the text which follows, the comminution member 112 is designated first comminution member, and the comminution members 114, 116 and 118 are designated second comminution members.

The comminution members 112, 114, 116 and 118 are in the form of identical disks 120, 122, 124 and 126. They each comprise a grating portion 128 with grating bars 129, the grating portion 128 being surrounded by a contour, the diameter of which is equal to the diameter of the flow channel 48 in the dispensing body 100. Each grating portion 128 is surrounded by an edge portion 130 which, when the disks 120, 122, 124, 126 are seen in plan view, is in the form of a ring from which two segments of the ring have been removed, said ring segments being diametrically opposite one another.

Consequently, each disk 120, 122, 124 and 126 has two contact edges 132 and 134 which run parallel to one another. When the disks 120, 122, 124 and 126 are disposed in the gap-like through-openings 102, the contact edges 132 and 134 can each rest against the base wall 104 and the top wall 106. The edge portion 130 can rest against the side walls 108 and 110, so that, overall, as mentioned, the disks 120, 122, 124 and 126 are held in the accommodation body 120 in a positively-locking manner.

The manner of operation of the comminution members 112, 114, 116 and 118 corresponds to the manner of operation of the comminution members 32, 34, 36 and 38 described above:

In first instance, only the first comminution member 112 is disposed in the accommodation body 100, for example in the comminution member receptacle 76. As a result, the grating portion 128 is positioned in the flow channel 48, the grating bars 129 reducing the size of the cross-section of the flow channel 48. The reduction in the size of the cross-section of the flow channel 48 can be identified in FIG. 7D, in which the flow channel contour 94 is indicated over the contour of the grating portion 128. Dry ice granules which are conducted through the flow channel 48 by means of compressed gas can strike the grating bars 129 and become comminuted as a result, so that an individual degree of comminution of dry ice granules can be achieved by means of the first comminution member 112.

Now, the second comminution members 114, 116 and 118 can also be disposed in the accommodation body 100, in addition to the first comminution member 112. The comminution members 112, 114, 116 and 118 can assume a plurality of positions in the comminution member receptacles 76, 78, 80 and 82, depending on whether the contact edges 132 and 134 rest against the base wall 104 or against the top wall 106. The comminution members 112, 114, 116 and 118 can be moved from one position to another position by rotation about the axis 18, about the axis 96, which in the present case is considered to be oriented perpendicular to the base wall 104, and also about an axis 136 which is oriented perpendicular to the axes 18 and 96 (see FIGS. 2 and 6).

Figures 7A, 7B, 7C, 7D:
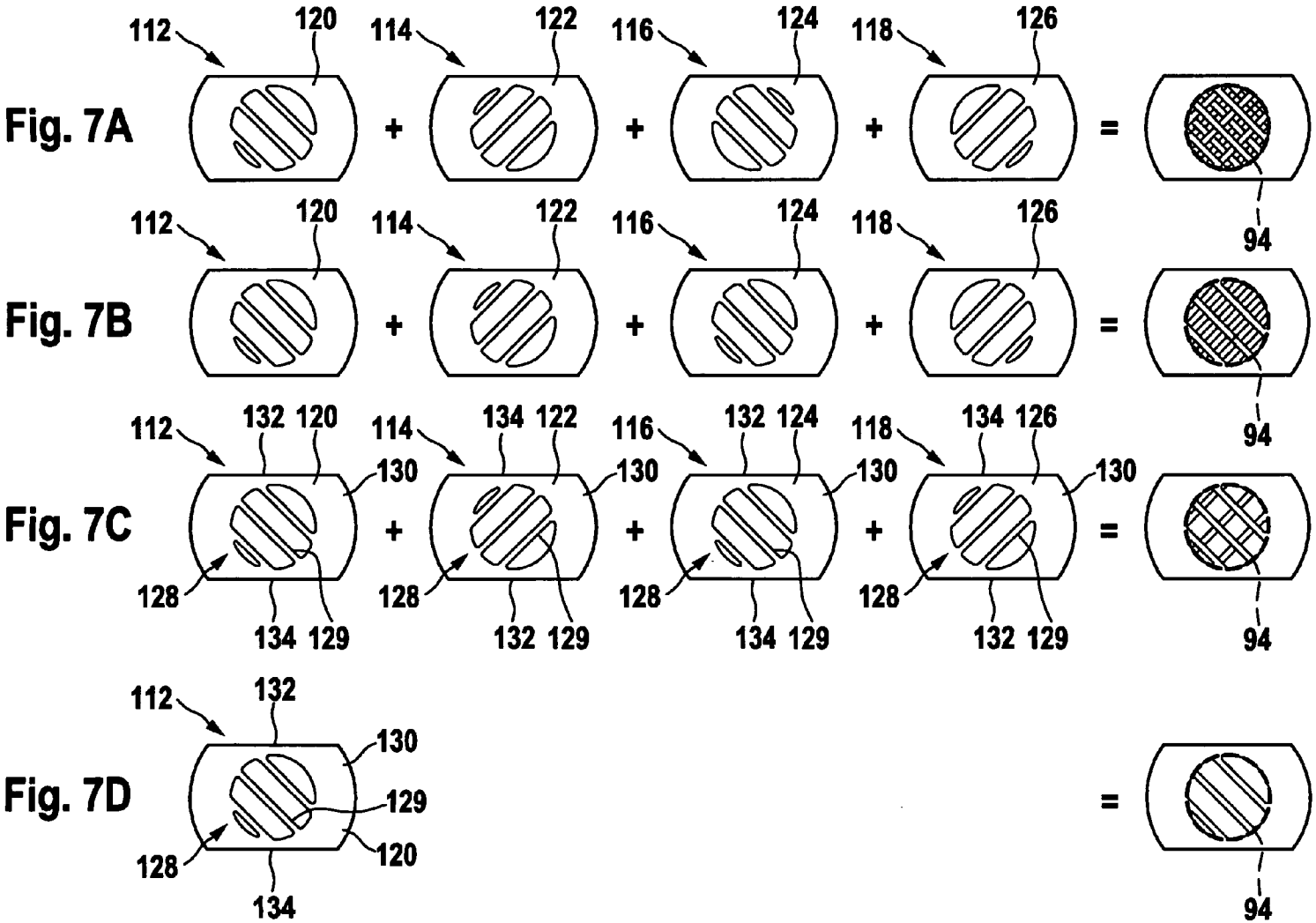
FIGS. 7A, 7B, 7C: show possible examples of the combination of comminution members of the device from FIG. 1 according to a second embodiment for achieving different total degrees of comminution.
FIG. 7D: shows a view similar to that of FIGS. 7A to 7C with just one comminution member.

Depending on the position of the comminution members 112, 114, 116 and 118 in the comminution member receptacles 76, 78, 80 and 82, that is to say depending on the orientation of the grating portions 128 of the comminution members 112, 114, 116 and 118 relative to one another, it is possible to reduce the size of the cross-section of the flow channel 48 to different degrees (FIGS. 7A to 7C). On account of the different reductions in size of the cross-section of the flow channel 48, it is therefore possible to achieve total degrees of comminution of dry ice granules which are greater than the individual degree of comminution which can be achieved solely by the first comminution member 112.

In this case, it has proven advantageous for the grating portion 128 to be non-symmetrical with respect to the axis 18 when the comminution members 112, 114, 116 and 118 are arranged in the accommodation body 100. It is therefore possible to achieve four total degrees of comminution (not shown in the drawing) by means of two comminution members, for example by means of comminution members 112 and 114, by virtue of their relative arrangement. Of these, three total degrees of comminution are greater than the individual degree of comminution which can be achieved solely by the first comminution member 112 because the grating portions 128, as viewed along the flow channel 48, can assume a crossed position relative to one another. Because of the identical configuration of the comminution members 112, 114, there also exists a total degree of comminution which is equal to the degree of comminution which can be achieved solely by the first comminution member 112. This total degree of comminution is achieved when the grating portions 128 of the comminution members 112 and 114, as viewed along the flow channel 48, are congruent.

The invention also relates to a dry ice dispensing arrangement, a preferred embodiment of said dry ice dispensing arrangement being schematically illustrated in FIG. 8 and being provided with reference symbol 140. The dry ice dispensing arrangement 140 comprises a dry ice spraying unit 142 which can be connected to a compressed gas source (not shown in the drawing) via a pressure line 144. The dry ice spraying unit 142 has a reservoir container 146 for dry ice granules, it being possible to mix, by way of a metering device 148, said dry ice granules with the compressed gas conducted through the pressure line 144.

The mixture of compressed gas and dry ice granules can be fed via a feed line 154 to a dry ice dispensing unit 150, which is part of the dry ice dispensing arrangement and is in the form of a spray gun 152. The mixture of dry ice granules and compressed gas can act upon a surface to be cleaned by operating an actuating lever 156 of the spray gun 152.

The above-described comminutor 10 is likewise part of the dry ice dispensing arrangement 140 and can be releasably connected to the spray gun 152 by screwing. To this end, an outlet 158 of the spray gun 152 comprises an external thread (not shown in the drawing) which can interact with the above-mentioned internal thread at the first sleeve end 20 of the sleeve 14.

A user can employ the comminutor 10 to reduce the size of the dry ice granules provided by the dry ice spraying unit 142 in the manner described above. On account of the different ways of arranging the comminution members 32, 34, 36 and 38 and, respectively, 112, 114, 116 and 118, in the accommodation bodies 30 and, respectively, 100, it is possible to achieve a large number of total degrees of comminution of dry ice granules, so that the dry ice dispensing arrangement 140 is versatile.

The invention claimed is:

1. Device for comminuting dry ice granules, comprising:

a housing having a flow channel for dry ice granules which can be applied, by means of compressed gas, to a surface to be cleaned, a first comminution member for comminuting the dry ice granules which are to be dispensed, at least one second comminution member which can be disposed in the housing in a position in which a total degree of comminution, which is greater than an individual degree of comminution which can be achieved solely by the first comminution member, can be achieved in combination with the first comminution member, and an accommodation body positioned within the housing with at least two comminution member receptacles for the first and the at least one second comminution members, respectively, wherein each of the first and the at least one second comminution members can be removably disposed in at least two positions in the respective receptacles such that they cannot move relative to the channel.

2. Device according to claim 1, wherein the at least one second comminution member can be disposed in the housing in a position in which the total degree of comminution is equal to the individual degree of comminution which can be achieved solely by the first comminution member.

3. Device according to claim 1, wherein the at least one second comminution member can be disposed in the housing in a plurality of positions in which the total degree of comminution is greater than the individual degree of comminution which can be achieved solely by the first comminution member.

4. Device according to claim 3, wherein the magnitude of the total degree of comminution differs in each of the plurality of positions of the at least one second comminution member in the housing.

5. Device according to claim 1, wherein at least one of the at least one second comminution members is identical to the first comminution member.

6. Device according to claim 1, wherein at least one of the at least one second comminution members is different from the first comminution member.

7. Device according to claim 1, wherein at least one of the first comminution member and the at least one second comminution member comprises a grating portion which can be positioned in the flow channel.

8. Device according to claim 7, wherein the at least one second comminution member can be moved to different positions, in which different total degrees of comminution can be achieved, by rotation of its grating portion relative to the grating portion of the first comminution member.

9. Device according to claim 1, wherein at least one of the first comminution member and the at least one second comminution member has an edge portion by way of which at least one of the first comminution member and the at least one second comminution member can be supported on the housing.

10. Device according to claim 1, wherein at least one of the first comminution member and the at least one second comminution member is of disk-like form.

11. Device according to claim 1, wherein the first and the at least one second comminution member, when they are disposed in the housing, are spaced apart from one another along the flow channel.

12. Device according to claim 1, wherein each of the at least two comminution member receptacles having a respective contact surface for at least one of the first comminution member and the at least one second comminution member, against which contact surface said comminution member can rest and can be oriented relative to the flow channel.

13. Device according to claim 1, wherein the accommodation body is in the form of a hollow body which surrounds the flow channel, at least along a sub-portion.

14. Device according to claim 1, wherein each of the at least two comminution member receptacles are in the form of a groove-like recess which is oriented transverse to the flow channel.

15. Device according to claim 1, wherein each of the at least two comminution member receptacles are in the form of a gap-like through-opening which is oriented transverse to the flow channel.

16. Device according to claim 1, wherein the accommodation body can be fixed such that it cannot move relative to the flow channel.

17. Device according to claim 1, wherein the housing has a sleeve which surrounds the accommodation body.

18. Device according to claim 17, wherein the housing has at least one housing cover which can be releasably connected to the sleeve.

19. Dry ice dispensing arrangement for dispensing a mixture of compressed gas and dry ice granules, comprising:

at least one device for comminuting dry ice granules, said device comprising:

a housing having a flow channel for dry ice granules which can be applied, by means of compressed gas, to a surface to be cleaned, a first comminution member for comminuting the dry ice granules which are to be dispensed, at least one second comminution member which can be disposed in the housing in a position in which a total degree of comminution, which is greater than an individual degree of comminution which can be achieved solely by the first comminution member, can be achieved in combination with the first comminution member, and an accommodation body positioned within the housing with at least two comminution member receptacles for the first and the at least one second comminution members, respectively, wherein each of the first and the at least one second comminution members can be removably disposed in at least two positions in the respective receptacles such that they cannot move relative to the channel.

* * * * *